US007246581B2

(12) United States Patent
Suga et al.

(10) Patent No.: US 7,246,581 B2
(45) Date of Patent: Jul. 24, 2007

(54) VARIABLE VALVE TIMING CONTROL APPARATUS OF INTERNAL COMBUSTION ENGINE

(75) Inventors: Seiji Suga, Kanagawa (JP); Tomoya Tsukada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 112 days.

(21) Appl. No.: 11/213,924

(22) Filed: Aug. 30, 2005

(65) Prior Publication Data

US 2006/0042580 A1 Mar. 2, 2006

(30) Foreign Application Priority Data

Aug. 31, 2004 (JP) ..... 2004-252258

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,006,708 A * 12/1999 Ken et al. ..... 123/90.17

FOREIGN PATENT DOCUMENTS

JP 2002-030908 A 1/2002

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A variable valve timing control apparatus employs a five-blade vane member fixedly connected to a camshaft end and rotatably disposed in a phase-converter housing formed integral with a sprocket driven by an engine crankshaft. Five phase-retard chambers and five phase-advance chambers are defined by five blades of the vane member and the housing, for creating a phase change of the vane member relative to the housing. A circumferential width of each of a first pair of blades, located on both sides of a first blade having a maximum circumferential width, is dimensioned to be less than a circumferential width of each of a second pair of blades, circumferentially spaced apart from the first blade rather than the first pair. The circumferential width of each of the second pair of blades is dimensioned to be less than the maximum circumferential width of the first blade.

20 Claims, 6 Drawing Sheets

VARIABLE VALVE TIMING CONTROL APPARATUS OF INTERNAL COMBUSTION ENGINE

TECHNICAL FIELD

The present invention relates to a variable valve timing control apparatus of an internal combustion engine capable of variably adjusting an open-and-closure timing of an engine valve depending on an engine operating condition, and specifically to an automotive variable valve timing control apparatus employing a hydraulically-operated vane-type timing variator capable of varying a relative phase of a camshaft to an engine crankshaft by supplying working fluid (hydraulic pressure) selectively to either one of a phase-advance hydraulic chamber and a phase-retard hydraulic chamber.

BACKGROUND ART

In recent years, there have been proposed and developed various variable valve timing control systems each employing a phase converter, such as a hydraulically-operated vane-type timing variator. A hydraulically-operated vane-type timing variator has been disclosed in Japanese Patent Provisional Publication No. 2002-30908 (hereinafter is referred to as "JP2002-30908"). In the hydraulically-operated vane-type variable valve timing control (VTC) device disclosed in JP2002-30908, a vane member is fixedly connected to a camshaft end and rotatably enclosed in a cylindrical housing of a timing pulley whose opening ends are enclosed with front and rear covers. The front cover, the cylindrical housing, and the rear cover are integrally connected to each other by means of a plurality of bolts. Four phase-advance hydraulic chambers and four phase-retard hydraulic chambers are defined by four frusto-conical partition walls (four shoes) radially inwardly extending from the inner periphery of the cylindrical housing and four blades (four vanes) of the vane member. The rear plate is formed integral with a timing-chain sprocket (or a timing-belt pulley), which serves as a rotary member driven in synchronism with rotation of an engine crankshaft. The first one of the four vane blades has an axial bore that slidably accommodating therein a lock pin (or a lock piston). On the other hand, the front plate has a lock-pin hole formed in its axially inside end. Depending on an engine operating condition, the lock pin is selectively engaged with or disengaged from the lock-pin hole. For instance, during an engine starting period, the lock pin is brought into engagement with the lock-pin hole, thus constraining rotary motion (free rotation) of the vane member relative to the cylindrical housing and consequently preventing the camshaft from rotating relative to the crankshaft. As a result, the vane member is held at a phase-retarded angular position suited to the engine starting period. Additionally, in the hydraulically-operated vane-type VTC device disclosed in JP2002-30908, the circumferential width L1 of the first vane blade, having the axial bore slidably accommodating therein the lock pin, and the circumferential width L2 of the second vane blade, diametrically opposing the first vane blade, are both dimensioned to be wider than each of circumferential widths L3 and L4 of the remaining vane blades (that is, L1, L2>L3, L4). Such setting of the circumferential widths L1–L4 is effective to ensure a comparatively great phase change of the vane member relative to the cylindrical housing without causing rotational unbalance of the vane member having three or more blades.

SUMMARY OF THE INVENTION

In order to balance two contradictory requirements, namely shortened axial length of a VTC device and sufficient torque applied to a vane member for a phase change, it is preferable to increase the number of vane blades to five. Increasing the number of vane blades to five contributes to the increased pressure-receiving area of each of phase-advance hydraulic chambers and phase-retard hydraulic chambers. However, in case of a hydraulically-operated vane-type timing variator employing a five-blade vane member having circumferentially equidistant-spaced, five vane blades, there is no blade existing in a position diametrically opposing the first vane blade having a lock-pin bore slidably accommodating therein a lock pin. Thus, the hydraulically-operated five-blade vane member equipped timing variator has difficulty in accurately maintaining rotational balance of the vane member. In presence of the deteriorated rotational balance of the five-blade vane member, there is an increased tendency for the rotational accuracy concerning normal-rotation and reverse-rotation to be lowered. As a result of this, the control accuracy of the VTC device also tends to be deteriorated.

Accordingly, it is an object of the invention to provide a hydraulically-operated five-blade vane member equipped variable valve timing control apparatus of an internal combustion engine, capable of reducing rotational unbalance of the five-blade vane member and ensuring an increased phase change of the vane member relative to a cylindrical housing fixedly connected to either one of an engine crankshaft and a camshaft.

In order to accomplish the aforementioned and other objects of the present invention, a variable valve timing control apparatus of an internal combustion engine comprises a rotary member adapted to be driven by an engine crankshaft, a camshaft rotatable relative to the rotary member and adapted to have a series of cams for operating engine valves, a phase converter comprising a rotary phase-converter housing integrally connected to one of the rotary member and the camshaft, and having a lock-piston hole formed in the housing, and a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers, a hydraulic circuit provided to supply hydraulic pressure selectively to either one of each of the phase-retard chambers and each of the phase-advance chambers to change a phase angle of the vane member relative to the housing, a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle, and an area of an outside circumference of each of a first pair of blades, located on both sides of the first blade having the bore slidably supporting the lock piston, being dimensioned to be less than an area of an outside circumference of each of a second pair of blades, circumferentially spaced apart from the first blade rather than the first pair.

According to another aspect of the invention, a variable valve timing control apparatus of an internal combustion engine comprises a rotary member adapted to be driven by an engine crankshaft, a camshaft rotatable relative to the rotary member and adapted to have a series of cams for operating engine valves, a phase converter comprising a rotary phase-converter housing integrally connected to one of the rotary member and the camshaft, and having a lock-piston hole formed in the housing, and a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers, a hydraulic circuit provided to supply hydraulic pressure selectively to either one of each of the phase-retard chambers and each of the phase-advance chambers to change a phase angle of the vane member relative to the housing, a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle, and a magnitude of centrifugal force acting on each of a first pair of blades, located on both sides of the first blade having the bore slidably supporting the lock piston, being set to be less than a magnitude of centrifugal force acting on each of a second pair of blades, circumferentially spaced apart from the first blade rather than the first pair.

According to a further aspect of the invention, a variable valve timing control apparatus of an internal combustion engine comprises a rotary member adapted to be driven by an engine crankshaft, a camshaft rotatable relative to the rotary member and adapted to have a series of cams for operating engine valves, a phase converter comprising a rotary phase-converter housing integrally connected to one of the rotary member and the camshaft, and having a lock-piston hole formed in the housing, and a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers, a hydraulic circuit provided to supply hydraulic pressure selectively to either one of each of the phase-retard chambers and each of the phase-advance chambers to change a phase angle of the vane member relative to the housing, a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle, and a maximum circumferential width of each of a first pair of blades, located on both sides of the first blade having the bore slidably supporting the lock piston, being dimensioned to be less than a maximum circumferential width of each of a second pair of blades, circumferentially spaced apart from the first blade rather than the first pair.

The other objects and features of this invention will become understood from the following description with reference to the accompanying drawings.

DESCRIPTION OF THE PREFERRED EMBODIMENTS

Figure 1:
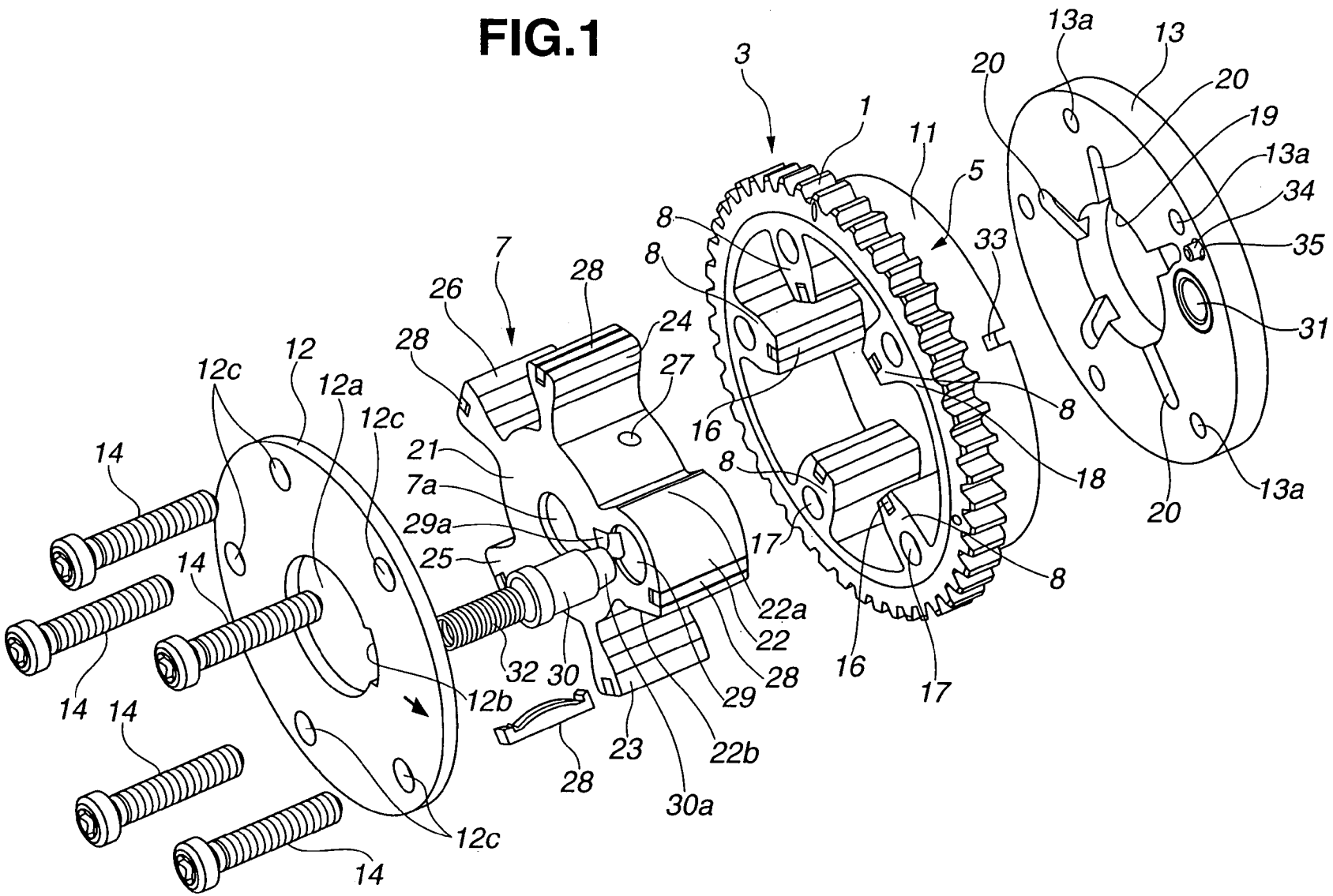
FIG. 1 is a disassembled view illustrating an embodiment of a hydraulically-operated five-blade vane member equipped variable valve timing control (VTC) apparatus.

Referring now to the drawings, particularly to FIGS. 1–5, the variable valve timing control (VTC) apparatus of the embodiment is exemplified in an internal combustion engine with a hydraulically-operated vane-type timing variator.

Figure 2:
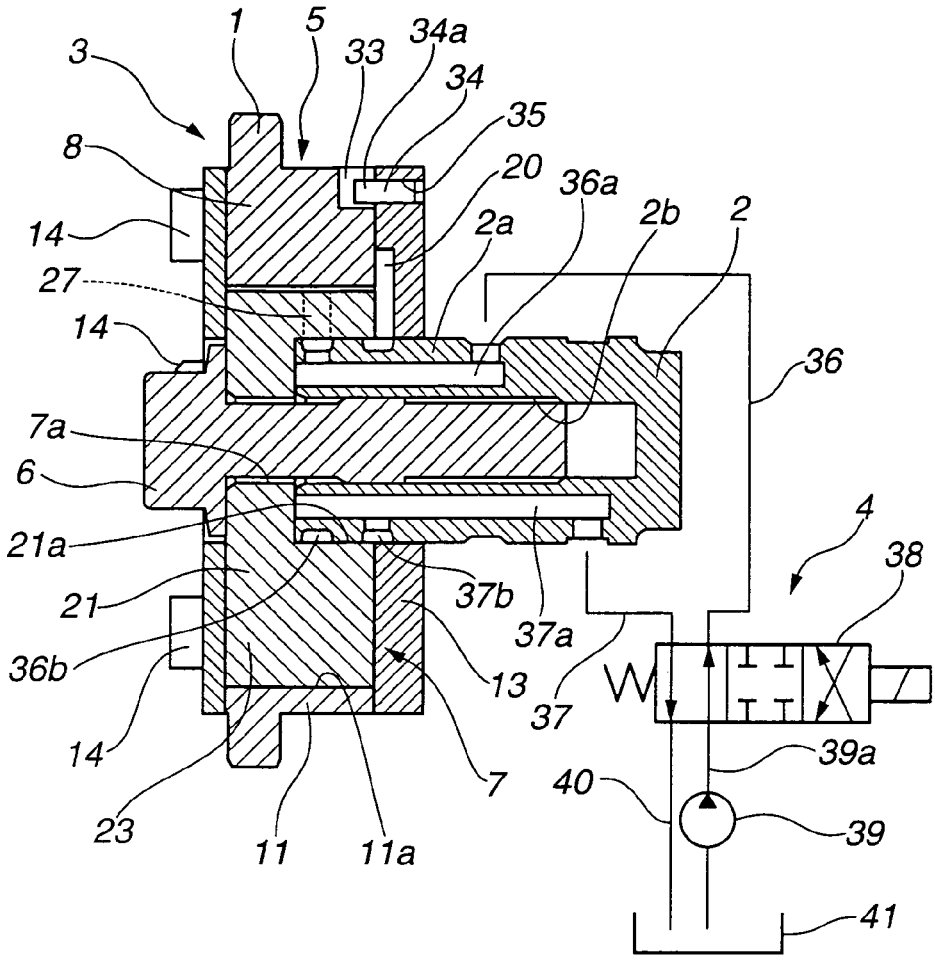
FIG. 2 is a system diagram illustrating an automotive variable valve timing control system with the five-blade vane member equipped VTC apparatus of the embodiment, cross-sectioned.

As best seen in FIG. 2, the VTC apparatus of the embodiment is comprised of a disc-shaped sprocket 1, a camshaft 2, a phase converter 3, and a hydraulic circuit 4. Sprocket 1 serves as a rotary member, which is driven by an engine crankshaft (not shown) via a timing chain. Camshaft 2 is provided to be rotatable relative to sprocket 1. Rotary motion of camshaft 2 relative to sprocket 1 is permitted via phase converter 3. Phase converter 3 is disposed between sprocket 1 and camshaft 2 for converting or changing an angular phase of camshaft 2 relative to sprocket 1. Hydraulic circuit 4 is connected to phase converter 3 to hydraulically operate phase converter 3.

Camshaft 2 is rotatably supported on a cylinder head (not shown) by means of cam bearings. Camshaft 2 has a series of cams formed integral with the camshaft, for opening and closing engine valves via valve lifters (not shown). Camshaft 2 has an axially-extending female screw-threaded portion 2*b* formed in a camshaft end 2*a*.

Phase converter 3 includes a substantially cylindrical, rotary phase-converter housing 5 installed on or integrally connected to camshaft end 2*a*, so that relative rotation between camshaft 2 and phase-converter housing 5 is permitted, and a five-blade vane member 7 fixedly connected or bolted to camshaft end 2*a* by means of a cam bolt (or a vane mounting bolt) 6 and rotatably disposed in phase-converter housing 5. In the VTC apparatus of the embodiment, five-blade vane member 7 has five blades 22, 23, 24, 25, and 26, while phase-converter housing 5 is integrally formed with five partition wall portions (simply, five shoes) 8, 8, 8, 8, and 8 each protruding radially inwards from and integrally formed with the inner periphery of the cylindrical housing. As clearly shown in FIGS. 4–5, five phase-retard chambers 9, 9, 9, 9, and 9 and five phase-advance chambers 10, 10, 10, 10, and 10 are defined by five shoes 8 of phase converter housing 5 and five blades 22–26. That is, five-blade vane member 7 and five shoes 8 of phase-converter housing 5 cooperate with each other to partition the internal space of housing 5 into the first group of phase-advance hydraulic chambers 10 and the second group of phase-retard hydraulic chambers 9.

Figure 4:
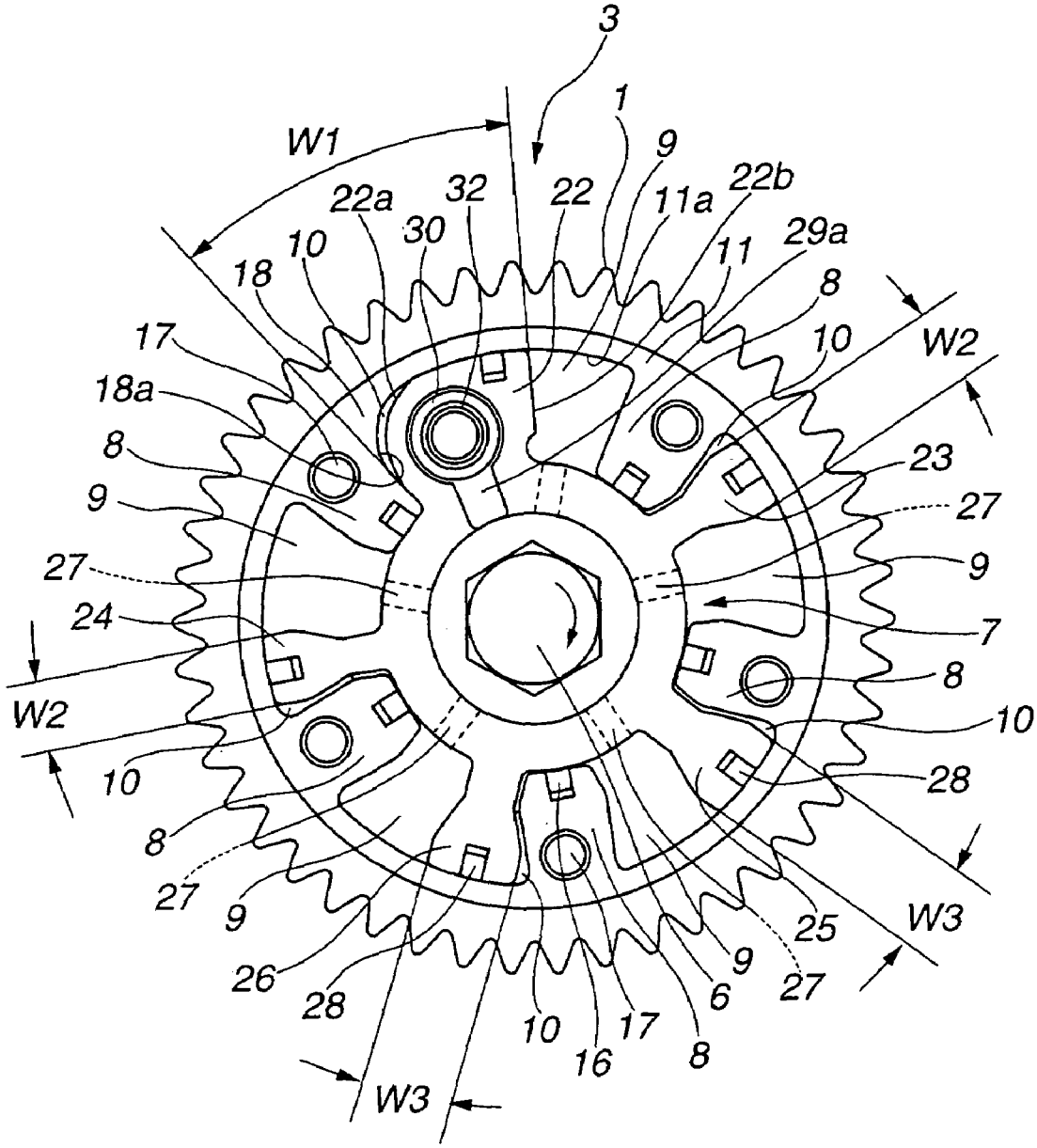
FIG. 4 is an explanatory view showing the vane member of the five-blade vane member equipped VTC apparatus controlled to a maximum phase-retard position.
Figure 5:
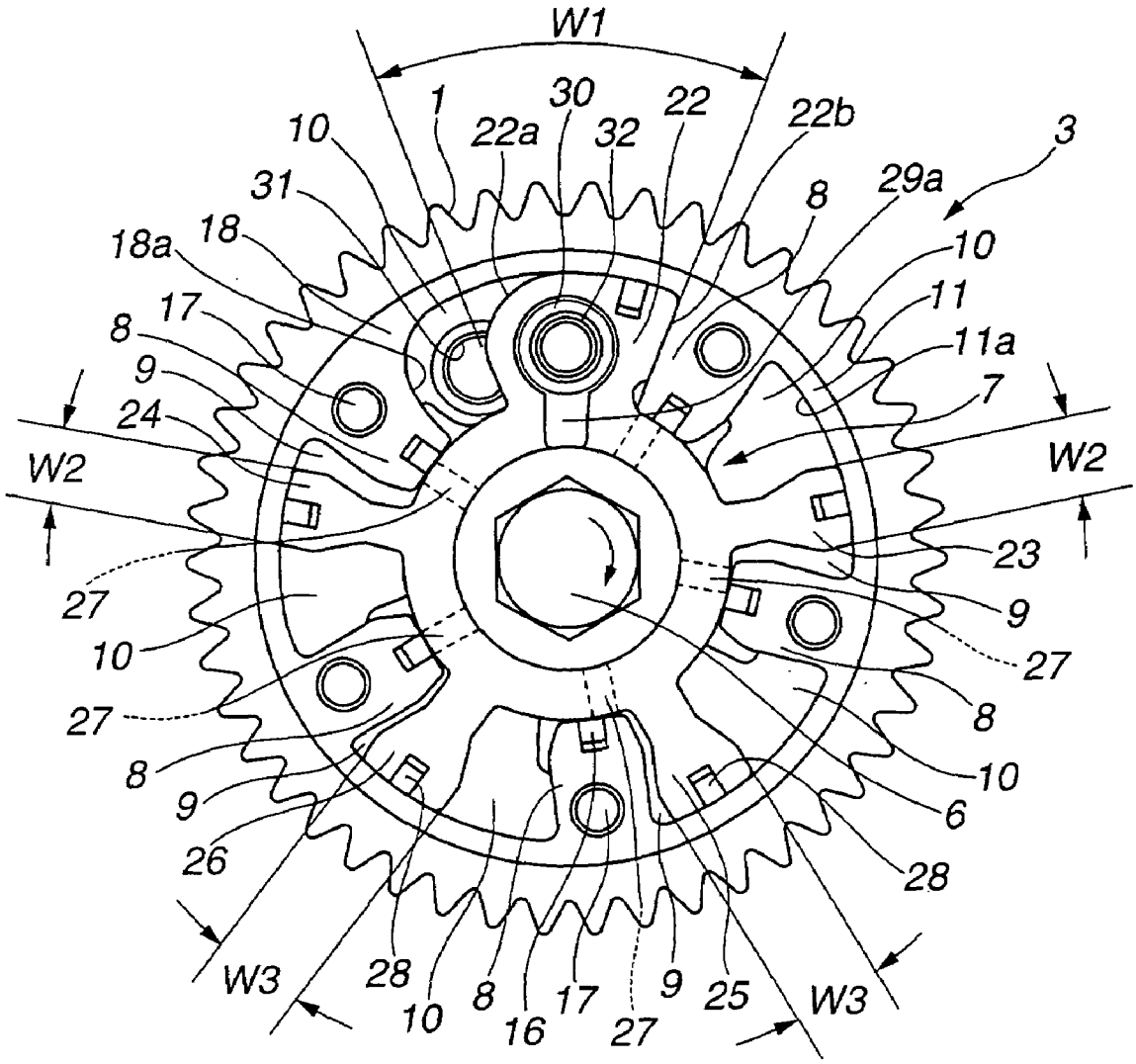
FIG. 5 is an explanatory view showing the vane member of the five-blade vane member equipped VTC apparatus controlled to a maximum phase-advance position.

Phase-converter housing 5 is comprised of a substantially cylindrical, main housing portion 11, and front and rear plate portions 12 and 13. The left-hand opening end (viewing the longitudinal cross-section of FIG. 2) of main housing portion 11 is hermetically covered by front plate portion 12, while the right-hand opening end of main housing portion 11 is hermetically covered by rear plate portion 13. Front plate portion 12, main housing portion 11, and rear plate portion 13 are arranged in that order and integrally connected to each other by tightening five bolts 14. Sprocket 1 is integrally formed with the outer periphery of main housing portion 11. Main housing portion 11 is comprised of a porous housing, which is made of a porous sintered metal member such as sintered alloy materials. After sintering-die forming, the whole sintered metal member (main housing portion 11) is subjected to heat treatment for the purpose of the enhanced mechanical strength and enhanced hardness. As best shown in FIGS. 1, 4, and 5, main housing portion 11 of phase-converter housing 5 has five shoes 8 integrally formed with the inner periphery of main housing portion 11 and substantially equidistant-spaced from each other in the circumferential direction. As viewed from the axial direction, each of shoes 8 is substantially U-shaped. Each of shoes 8 has an axially-elongated seal groove formed in its apex. Five elongated oil seals 16, each being square in lateral cross section, are fitted into the respective seal grooves of shoes 8. Each of shoes 8 has an axially-extending bolt insertion hole 17 formed in its root portion such that bolt 14 is inserted into bolt insertion hole 17. As clearly shown in FIGS. 4–5, the first one of five shoes 8 is integrally formed at its root portion with a circumferentially thick-walled portion 18 well-contoured in one circumferential direction. The outer peripheral wall surface 18*a* of thick-walled or well-contoured portion 18 is circular-arc shaped, in such a manner that well-contoured portion 18 is smoothly curved from the leading edge portion (as viewed in the direction of rotation of the VTC mechanism indicated by the arrow in FIGS. 4–5) of the first shoe 8 having well-contoured portion 18 to an inner peripheral wall surface 11*a* of main housing portion 11.

As best seen in FIG. 1, front plate portion 12 is formed as a comparatively thin-walled disc-shaped member by way of pressing. Front plate portion 12 has a centrally-bored, large-diameter through opening 12*a* into which cam bolt 6 is inserted. A predetermined part of the inside circumference of central large-diameter through opening 12*a* of front plate portion 12 is cut out to provide a cutout groove (or a notched portion) 12*b*. Front plate portion 12 is formed with circumferentially equidistant-spaced, five bolt holes 12*c* such that bolt holes 12*c* surround central large-diameter through opening 12*a*.

As best seen in FIG. 1, rear plate portion 13 is thick-walled in comparison with front plate portion 12. Rear plate portion 13 is comprised of a substantially disc-shaped, porous plate, which is made of a porous sintered metal member such as sintered alloy materials. Rear plate portion 13 is formed at its center with a housing supporting bore 19, into which camshaft end 2*a* is inserted, so that the inner periphery of rear plate portion 13 is rotatably supported on the outer periphery of camshaft end 2*a*. As clearly shown in FIGS. 1–2, rear plate portion 13 is also formed with five phase-advance radial oil grooves 20 radially extending from the inner peripheral wall of housing supporting bore 19 and communicating the respective phase-advance chambers 10. Rear plate portion 13 is formed with circumferentially equidistant-spaced, five female screw-threaded portions 13*a* into which the male screw-threaded portions of bolts 14 are screwed. After sintering-die forming, the whole sintered metal member (rear plate portion 13) is not subjected to heat treatment. Thus, the mechanical hardness of rear plate portion 13 is set to be lower than that of cylindrical housing portion 11 formed integral with sprocket 1.

Figure 3:
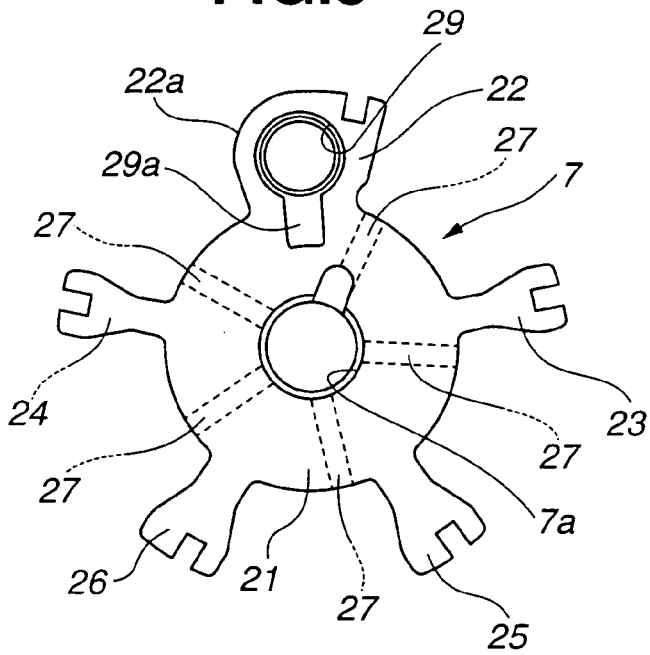
FIG. 3 is a front view illustrating the five-blade vane member of the VTC apparatus of the embodiment.

Vane member 7 is made of metal materials. As shown in FIGS. 2–3, vane member 7 is comprised of a substantially annular ring-shaped vane rotor 21 and five radially-extending vanes or blades 22, 23, 24, 25, and 26. Vane rotor 21 and five vane blades 22, 23, 24, 25, and 26 are integrally formed with each other. Vane rotor 21 of vane member 7 has an axially-extending central bore 7*a* into which cam bolt (vane mounting bolt) 6 is inserted for bolting vane member 7 to camshaft end 2*a* by axially tightening the cam bolt. Five blades 22, 23, 24, 25, and 26 are formed integral with vane rotor 21, such that the five blades are substantially circumferentially spaced apart from each other, and that extend radially outwards from the outer periphery of vane rotor 21. Vane rotor 21 is rotatably supported by five elongated oil seals 16 fitted into the seal grooves of five shoes 8, while being in sliding-contact with five elongated oil seals 16. As can be seen in FIGS. 1–5, vane rotor 21 has five phase-retard radial oil holes or radial oil galleries 27 formed therein and radially extending from the inner peripheral wall of central bore 7*a*. Five phase-retard radial oil galleries 27 communicate the respective phase-retard chambers 9. As shown in FIG. 2, vane rotor 21 is formed on the right-hand side facing camshaft end 2*a* with a central cylindrical-hollow fitting groove 21*a* into which camshaft end 2*a* is fitted. The two adjacent blades (22,23; 23,25; 25,26; 26,24; 24,22) are circumferentially spaced apart from each other by approximately 72 degrees. Each of five blades 22, 23, 24, 25, and 26 is disposed in an internal space defined between the associated two adjacent shoes 8 and 8. As best seen in FIGS. 1, 2, and 3, five apex seals 28, 28, 28, 28, and 28, each being square in lateral cross section, are fitted into respective seal grooves formed in apexes of five blades 22–26, so that each of blades 22–26 is slidable along the inner peripheral wall surface 11*a* of main housing portion 11 of phase-converter housing 5.

As clearly shown in FIGS. 3–5, in particular, FIGS. 4–5, in the hydraulically-operated five-blade vane member equipped VTC apparatus of the embodiment, the areas of the outside circumferences of five blades 22–26 of the five-blade vane member 7, in other words, the circumferential widths of five blades 22–26 are dimensioned or set to be somewhat different from each other. As hereunder described in detail, in the shown embodiment, five blades 22–26 are classified into three sorts, namely a maximum-width blade 22, a first pair of narrow-width blades 23–24, and a second pair of middle-width blades 25–26. The first blade 22, having an axial bore 29 (described later) slidably supporting or accommodating therein a lock piston 30 (described later), is designed or dimensioned to have a maximum circumferential width W1 (see FIGS. 4–5). Two blades 23 and 24 included in the first pair, arranged on both sides of the first blade 22 and located closer to the first blade 22 rather than two blades 25 and 26 included in the second pair, are designed or dimensioned to have a minimum circumferential width W2. Blades 25–26 included in the second pair, which are circumferentially spaced apart from the first blade 22 rather than blades 23–24 included in the first pair, are designed or dimensioned to have a middle circumferential width W3 greater than the maximum circumferential width W1 of the first blade 22 and less than the minimum circumferential width W2 of each of narrow-width blades 23–24 included in the first pair. In more detail, the first blade 22 has the axial bore 29 (described later) slidably accommodating therein the lock piston 30 (described later), and therefore the circumferential width W1 of the first blade 22 has to be dimensioned or set to have the maximum width. In the shown embodiment, the circumferential width W2 of one blade 23 included in the first pair (the narrow-width blade pair) is dimensioned or set to be substantially identical to that of the other blade 24 included in the first pair (23, 24). Additionally, in the five-blade vane member structure of the embodiment, the sum (W2+W2) of circumferential widths of narrow-width blades 23–24 included in the first pair (23, 24) is dimensioned or set to be less than the circumferential width W1 of the first blade 22, that is, (W2+W2)<W1. In the shown embodiment, the circumferential width W3 of one blade 25 included in the second pair of middle-width blades 25–26 is dimensioned or set to be substantially identical to that of the other blade 26 included in the second pair (25, 26). In the five-blade vane member structure of the embodiment, the circumferential width W3 of each of middle-width blades 25–26 included in the second pair (25, 26) is dimensioned or set to be less than the circumferential width W1 of the first blade 22 and greater than the circumferential width W2 of each of narrow-width blades 23–24 included in the first pair (23, 24), that is, W2<W3<W1. Additionally, the sum (W3+W3) of circumferential widths of middle-width blades 25–26 included in the second pair (25, 26) is dimensioned or set to be greater than the circumferential width W1 of the first blade (maximum-circumferential-width blade) 22, that is, (W3+W3)>W1. In the shown embodiment, narrow-circumferential-width blades 23 and 24 are arranged on both sides of maximum-circumferential-width blade 22, and located closer to maximum-circumferential-width blade 22 rather than middle-circumferential-width blades 25 and 26. Each of the two adjacent middle-circumferential-width blades 25 and 26 is circumferentially spaced apart from maximum-circumferential-width blade 22, rather than each of narrow-circumferential-width blades 23 and 24.

The first blade (maximum-circumferential-width blade) 22 is formed at one side facing the well-contoured portion 18 of the first shoe 8 with a notched portion (or a cutout portion) 22*a*. The notched portion 22*a* of the first blade 22 is circular-arc shaped and contoured to have almost the same curvature as the circular-arc shaped outer peripheral wall surface 18*a* of well-contoured portion 18 of the first shoe 8. As viewed from the front end of the five-blade vane member equipped VTC apparatus shown in FIG. 4, under a particular condition where vane member 7 has been rotated in the maximum counterclockwise direction and held at the maximum phase-retard position, the left-hand side of the first blade 22 is in abutted-engagement with the leading edge portion of the first shoe 8, while there is a slight circular-arc shaped clearance space defined between the circular-arc shaped outer peripheral wall surface 18*a* of well-contoured portion 18 and the circular-arc shaped, notched portion 22*a* of the first blade 22. The other side (the flat sidewall) 22*b* of the first blade 22, facing apart from the well-contoured portion 18 of the first shoe 8, is formed as the same flat sidewall as the second shoe 8, located adjacent to the first shoe and circumferentially spaced from the first shoe in the clockwise direction (viewing FIGS. 4–5). As can be appreciated from the front end view of the five-blade vane member equipped VTC apparatus shown in FIG. 5, the maximum rotary motion of vane member 7 relative to main housing portion 11 in the phase-advance direction is restricted by way of abutment between the other side (the flat sidewall) 22*b* of the first blade 22 and the sidewall of the second shoe 8. In a similar manner, as can be appreciated from the front end view of the five-blade vane member equipped VTC apparatus shown in FIG. 4, the maximum rotary motion of vane member 7 relative to main housing portion 11 in the phase-retard direction is restricted by way of abutment between the sidewall of the root portion of the first blade 22 being continuous with the circular-arc shaped, notched portion 22*a* and the sidewall of the opposing shoe (the first shoe 8).

Also provided is a lock mechanism that is provided between the first blade 22 and rear plate portion 13 to constrain rotary motion (free rotation) of vane member 7 relative to main housing portion 11 of phase-converter housing 5. As best seen in FIG. 1, the lock mechanism is comprised of axial bore (axial through opening) 29 formed in the first blade 22, lock piston 30 slidably accommodated in axial bore 29 so that lock piston 30 is movable toward and apart from rear plate portion 13, a lock-piston hole 31, and an engaging/disengaging mechanism (or a coupling/uncoupling mechanism). Lock-piston hole 31 is formed in an axially inside end of rear plate portion 13 and located in a predetermined circumferential position of rear plate portion 13. The tip portion 30*a* of lock piston 30 can be engaged with lock-piston hole 31 formed in rear plate portion 13 by way of forward movement of lock piston 30. On the contrary, the tip portion 30*a* can be disengaged from lock-piston hole 31 by way of backward movement of lock piston 30. Movement of lock piston 30 into and out of engagement with lock-piston hole 31 is controlled by means of the coupling/uncoupling mechanism (simply, coupling mechanism). In the shown embodiment, axial bore 29 is formed or bored in a substantially central position of the first blade 22 in the circumferential direction (see FIG. 3). Lock piston 30 is formed into a bullet shape. More concretely, lock pin 30 has a substantially cylindrical bore closed at one end. The closed end portion (the tip portion 30*a*) of lock piston 30 is formed as a substantially frusto-conical, stepped portion, which enables easy engagement with lock-piston hole 31. The first blade 22 has a partially cutout groove 29*a*, being square in lateral cross section, and locally cut out at the radially innermost end portion of axial bore 29 and formed in one sidewall of the first blade 22 facing front plate portion 12. In the whole range of all rotational positions of vane member 7, the axial-bore cutout portion 29*a* of the first blade 22 and the previously-noted cutout groove 12*b* of central through opening 12*a* of front plate portion 12 are permanently communicated with each other. That is, the axial-bore cutout portion 29*a* of the first blade 22 and the cutout groove 12*b* of front plate portion 12 cooperate with each other to provide an air bleeder (an air-bleeder-hole function) that ensures good sliding motion of lock piston 30. Lock-piston hole 31 of rear plate portion 13 is formed as a cylindrical bore closed at one end. As best seen in FIG. 5, lock-piston hole 31 is formed in rear plate 13 and arranged in a position offsetting toward the phase-advance chamber 10 from the center of the sector internal space defined between the first and second shoes 8, 8 between which the first blade 22 is disposed. The circumferential position of lock-piston hole 31 formed in rear plate portion 13 and the circumferential position of lock piston 30 slidably mounted in the first blade 22 of vane member 7 are set so that the angular phase (or phase angle) of vane member 7 (or camshaft 2) relative to phase-converter housing 5 (or the crankshaft or sprocket 1) is held at the maximum phase-retard position suited to an engine starting period by way of engagement between lock piston 30 and lock-piston hole 31.

The coupling mechanism, which controls movement of lock piston 30 into and out of engagement with lock-piston hole 31, is comprised of a coil spring (or a return spring) 32 and an uncoupling hydraulic circuit (not shown). Spring 32 is operably disposed between the rear end of lock piston 30 and the inside end face of front plate portion 12, for permanently forcing or biasing lock piston 30 in such a manner as to create movement of lock piston 30 into engagement with lock-piston hole 31 by forward sliding movement of lock piston 30. On the other hand, the uncoupling hydraulic circuit supplies or applies hydraulic pressure into lock-piston hole 31 for creating backward sliding movement of lock piston 30. The uncoupling hydraulic circuit is constructed to have an additional oil passage or an additional oil hole through which working fluid (hydraulic pressure), selectively fed to either one of phase-retard hydraulic chamber 9 and phase-advance hydraulic chamber 10, is supplied into lock-piston hole 31 for disengagement of lock piston 30 from lock-pin hole 31.

Also provided is a positioning means (or a positioning mechanism) for the purpose of positioning between main housing portion 11 and rear plate portion 13 when assembling these component parts 11–13 by means of bolts 14. The positioning means is effective to easily determine the specified angular position of main housing portion 11 relative to rear plate portion 13, in other words, the specified angular position of the closed end portion (the tip portion 30*a*) of lock piston 30, slidably accommodated in axial bore 29 of vane member 7 circumferentially movable in main housing portion 11 within limits, relative to lock-pin hole 31, when assembling the two component parts 11 and 13.

As clearly shown in FIGS. 1–2, the positioning means is comprised of a positioning recess 33 and a positioning pin 34. Positioning recess 33 is integrally partially formed in a predetermined angular position of the outer peripheral edged portion of the rear end of main housing portion 11 facing rear plate portion 13. Positioning pin 34 is attached to the mated surface of rear plate portion 13 fitted onto the rear end face or the right-hand sidewall surface (viewing FIG. 1) of main housing portion 11. For easy accurate positioning (that is, to easily accurately achieve a predetermined relation between the circumferential position of main housing portion 11 and the circumferential position of rear plate portion 13, positioning pin 34 is installed or attached to rear plate portion 13 at a predetermined position of both of the radial direction as well as the circumferential direction. Thus, when assembling, the two mating parts, namely main housing portion 11 and rear plate portion 13, are accurately positioned in relation to each other by fitting positioning pin 34 into positioning recess 33. Actually, when sintering-die forming for main housing portion 11, positioning recess 33 is simultaneously integrally formed. As seen in FIGS. 1–2, positioning recess 33 is formed as a substantially rectangular slot radially extending along the mated surface of rear end plate 13, and located in the predetermined angular position substantially corresponding to a circumferential center of the previously-noted well-contoured portion 18 of the first shoe 8 of main housing portion 11. That is, the radially-extending rectangular-slotted positioning recess 33, partially integrally formed in the outer peripheral edged portion of the rear end of main housing portion 11, has an upper opening end and a backward opening end, thus avoiding the occurrence of an undesirable undercut portion during sintering-die forming for main housing portion 11. This facilitates the sintering-die forming work.

On the other hand, as shown in FIGS. 1–2, positioning pin 34 is press-fitted into an axial positioning-pin bore 35, which is axially bored in the outer peripheral portion of rear plate portion 13 at the predetermined position in both of the circumferential direction and the radial direction, and located close to lock-pin hole 31. As clearly shown in FIG. 2, the tip portion 34*a* of positioning pin 34 is slightly protruded out of the mating surface of rear plate portion 13 toward main housing portion 11, such that the tip portion 34*a* of positioning pin 34 mounted on rear plate portion 13 is brought into fitted-engagement axially with positioning recess 33 of main housing portion 11, when assembling. For accurate positioning between the angular position of main housing portion 11 and the angular position of rear plate portion 13, and for zero backlash (no occurrence of relative circumferential motion) of two parts, namely main housing portion 11 and rear plate portion 13, the circumferential width of positioning recess 33 and the outside diameter of the tip portion 34*a* of positioning pin 34 are properly dimensioned. Concretely, the circumferential width of positioning recess 33 is dimensioned or set to be slightly greater than the outside diameter of the tip portion 34*a* of positioning pin 34.

As best seen in FIG. 2, the previously-discussed hydraulic circuit 4 is provided to supply (or apply) working fluid (or hydraulic pressure) selectively to either one of each phase-retard hydraulic chamber 9 and each phase-advance hydraulic chamber 10 and to drain working fluid (or hydraulic pressure) selectively from either one of each phase-retard hydraulic chamber 9 and each phase-advance hydraulic chamber 10. Hydraulic circuit 4 is comprised of a phase-retard fluid line (or a phase-retard fluid passage) 36, a phase-advance fluid line (or a phase-advance fluid passage) 37, an oil pump 39, and a drain line (or a drain passage) 40. Phase-retard fluid line 36 communicates each of five phase-retard radial oil galleries 27 formed in vane rotor 21. Phase-advance fluid line 37 communicates each of five phase-advance radial oil grooves 20 formed in rear plate portion 13. Oil pump 39, serving as a hydraulic pressure source, is provided to supply working fluid (hydraulic pressure) selectively to either one of phase-retard fluid line 36 and phase-advance fluid line 37 via an electromagnetic directional control valve 38. Drain line 40 is selectively communicated with either one of phase-retard fluid line 36 and phase-advance fluid line 37 via directional control valve 38.

Phase-retard fluid line 36 is communicated with each of five phase-retard radial oil galleries 27 through an axial oil passage 36*a* and a radial oil passage 36*b* formed in camshaft end 2*a*, whereas phase-advance fluid line 37 is communicated with each of five phase-advance radial oil grooves 20 through an axial oil passage 37*a* and a radial oil passage 37*b* formed in camshaft end 2*a*.

Electromagnetic directional control valve 38 is comprised of a single solenoid-actuated four-way, three-position, spring-offset directional control valve. Directional control valve 38 is operated in response to a control signal from an electronic control unit (not shown), abbreviated to "ECU", so as to establish fluid communication between a first one of phase-retard fluid line 36 and phase-advance fluid line 37 and a discharge passage 39*a* of oil pump 39, and simultaneously establish fluid communication between the second fluid line and drain line 40, for a phase change (a phase advance or a phase retard) of camshaft 2 relative to sprocket 1. For a phase hold, directional control valve 38 is held at its valve shutoff position in response to a control signal from the control unit, so as to block fluid communication between the first fluid line of phase-retard fluid line 36 and phase-advance fluid line 37 and discharge passage 39*a* of oil pump 39, and simultaneously block fluid communication between the second fluid line and drain line 40. The control unit generally comprises a microcomputer. The control unit includes an input/output interface (I/O), memories (RAM, ROM), and a microprocessor or a central processing unit (CPU). The input/output interface (I/O) of the control unit receives input information from various engine/vehicle sensors, namely a crank angle sensor, an airflow meter, an engine temperature sensor (an engine coolant temperature sensor), and a throttle opening sensor. Within the control unit, the central processing unit (CPU) allows the access by the I/O interface of input informational data signals from the engine/vehicle sensors. The CPU of the control unit is responsible for carrying the phase control program stored in memories. Computational results (arithmetic calculation results), that is, a calculated output signal (or a control current) is relayed through the output interface circuitry of the control unit to output stages, namely a solenoid (exactly, an electrically energized solenoid coil) of electromagnetic directional control valve 38.

The hydraulically-operated five-blade vane member equipped VTC apparatus of the embodiment operates as follows.

As shown in FIG. 4, at the initial stage of an engine starting period, movement of the tip portion 30*a* of lock piston 30 into engagement with lock-piston hole 31 occurs, and then lock piston 30 is held in engagement with lock-piston hole 31. Thus, during the engine starting period, vane member 7 can be kept or constrained at a phase-retard position (substantially corresponding to the maximum phase-retard position) suited to the engine starting period. Thus, when the engine is started or restarted with an ignition switch turned ON, it is possible to ensure a smooth engine cranking performance, that is, a better engine startability, by virtue of vane member 7 held at the angular phase substantially corresponding to the maximum phase-retard position.

In a low-speed low-load range after the engine has been started or restarted, the electrically energized coil of directional control valve 38 is de-energized responsively to a control signal from the control unit. With directional control valve 38 de-energized, fluid communication between discharge passage 39*a* of oil pump 39 and phase-advance fluid line 37 is established and simultaneously fluid communication between phase-retard fluid line 36 and drain line 40 is established. Under such a fluid path established by directional control valve 38 de-energized, working fluid discharged from oil pump 39 is flown through phase-advance fluid line 37 into each of five phase-advance chambers 10, thus causing a rise in hydraulic pressure in each of five phase-advance chambers 10. At the same time, working fluid in each of five phase-retard chambers 9 is drained through phase-retard fluid line 36 and drain line 40 into an oil pan 41, thus causing a fall in hydraulic pressure in each of five phase-retard chambers 9. At this time, part of working fluid, fed into phase-advance chamber 10, flows into lock-piston hole 31, thus creating movement of lock piston 30 out of engagement with lock-piston hole 31, and enables vane member 7 to freely rotate within limits. Consequently, the applied hydraulic pressure permits vane member 7 to rotate in a rotational direction (i.e., in a phase-advance direction) that the volumetric capacity of each of five phase-advance chambers 10 increases. In accordance with an increase in the volumetric capacity of each phase-advance chamber 10, vane member 7 shifts or rotates clockwise from the angular phase substantially corresponding to the maximum phase-retard position (see FIG. 4) toward the angular phase substantially corresponding to the maximum phase-advance position (see FIG. 5). As previously described, the maximum rotary motion of vane member 7 relative to main housing portion 11 in the phase-advance direction is restricted by way of abutment between the flat sidewall 22*b* of the first blade 22 and the sidewall of the second shoe 8. In this manner, by rotary motion of vane member 7 toward the angular phase substantially corresponding to the maximum phase-advance position, an angular phase of camshaft 2 relative to sprocket 1 can be converted or changed to the phase-advance side.

On the contrary, when the engine operating condition is changed from the low-speed low-load range to-a high-speed high-load range, the electrically energized coil of directional control valve 38 is energized responsively to a control signal (or a control current) from the control unit. With directional control valve 38 energized, fluid communication between discharge passage 39*a* of oil pump 39 and phase-retard fluid line 36 is established and simultaneously fluid communication between phase-advance fluid line 37 and drain line 40 is established. Under such a fluid path established by directional control valve 38 energized, working fluid discharged from oil pump 39 is flown through phase-retard fluid line 36 into each of five phase-retard chambers 9, thus causing a rise in hydraulic pressure in each of five phase-retard chambers 9. At the same time, working fluid in each of five phase-advance chambers 10 is drained through phase-advance fluid line 37 and drain line 40 into oil pan 41, thus causing a fall in hydraulic pressure in each of five phase-advance chambers 10. At this time, part of working fluid, fed into phase-retard chamber 9, flows into lock-piston hole 31, and whereby lock piston 30 is kept out of engagement with lock-piston hole 31. As a result, vane member 7 can freely rotate within limits. Consequently, by way of the applied hydraulic pressure, vane member 7 rotates in the opposite rotational direction (i.e., in a phase-retard direction) that the volumetric capacity of each of five phase-retard chambers 9 increases. In accordance with an increase in the volumetric capacity of each phase-retard chamber 9, vane member 7 shifts or rotates counterclockwise toward the angular phase substantially corresponding to the maximum phase-advance position (see FIG. 4). As previously described, the maximum rotary motion of vane member 7 relative to main housing portion 11 in the phase-retard direction is restricted by way of abutment between the sidewall of the root portion of the first blade 22 being continuous with the circular-arc shaped, notched portion 22*a* and the sidewall of the opposing shoe (the first shoe 8). In this manner, by rotary motion of vane member 7 toward the angular phase substantially corresponding to the maximum phase-advance position, an angular phase of camshaft 2 relative to sprocket 1 can be converted or changed in the phase-advance direction. As a result of this, the intake valve open timing IVO and intake valve closure timing IVC are both controlled to the phase-retard side, thus enhancing engine power output in the high-speed high-load range.

As clearly shown in FIG. 4, in the maximum phase-retard position of vane member 7 in which the sidewall of the root portion of the first blade 22 is in abutted-engagement with the sidewall of the opposing shoe (the first shoe 8), note that the sidewalls of the other blades 23–26 are all kept out of contact with the respective sidewalls of the opposing shoes 8. In a similar manner, as clearly shown in FIG. 5, in the maximum phase-advance position of vane member 7 in which the flat sidewall 22*b* of the first blade 22 is in abutted-engagement with the sidewall of the opposing shoe (the second shoe 8), note that the sidewalls of the other blades 23–26 are all kept out of contact with the respective sidewalls of the opposing shoes 8.

Just after the engine is stopped, hydraulic pressure supply from oil pump 39 to each of five phase-retard chambers 9 and five phase-advance chambers 10 is stopped. At the same time, rotary motion of vane member 7 relative to main housing portion 11 toward the maximum phase-retard position takes place by alternating torque acting on camshaft 2. Thereafter, as soon as vane member 7 reaches the maximum phase-retard position, lock piston 30 is pushed out toward lock-piston hole 31 by means of the spring force of return spring 32, and as a result the tip portion 30*a* of lock piston 30 is brought into engagement with lock-piston hole 31. As previously discussed, accurate positioning between the angular position of lock piston 30 (the vane member side) and the angular position of lock-piston hole 31 (the rear plate side) in the circumferential direction of phase-converter housing 5, when assembling, is achieved by virtue of the positioning means (positioning recess 33 and positioning pin 34). During movement of lock piston 30 into engagement with lock-piston hole 31, such accurate positioning ensures a smooth engaging action of lock piston 30 with lock-piston hole 31.

That is, when component parts of the five-blade vane member equipped VTC apparatus of the embodiment are assembled to each other, in particular, when front and rear plate portions 12 and 13 are mounted on both faces of main housing portion 11 by means of bolts 14, first, front plate portion 12 is temporarily held on the front end face of main housing portion 11, accommodating therein vane member 7, by bolts 14. Second, positioning pin 34 of rear plate portion 13 is brought into engagement with positioning recess 33 of main housing portion 11 from the axial direction, while temporarily fitting or putting rear plate portion 13 on the rear end face of main housing portion 11. At the same time, the tip portion 30*a* of lock piston 30 has to be engaged with lock-piston hole 31 of rear plate portion 13, while installing both of lock piston 30 and coil spring 32 in axial bore (axial through opening) 29 formed in the first blade 22 of vane member 7. After this, the male screw-threaded portions of bolts 14 are screwed into the respective female screw-threaded portions 13*a* of rear plate portion 13, until the predetermined tightening torque for tightening each of bolts 14 is reached. In this manner, the three parts, namely front plate portion 12, main housing portion 11, and rear plate portion 13 are securely assembled to each other, while operably accommodating therein vane member 7 and lock piston 30. As appreciated from the above, when assembling, it is possible to accurately easily achieve circumferential positioning motion (positioning adjustment) of rear plate portion 13 relative to main housing portion 11 by virtue of the positioning means (positioning recess 33 and positioning pin 34). Therefore, even in presence of a slight circumferential displacement between the center of each bolt 14 and the center of the associated bolt insertion hole 17 of main housing portion 11, it is possible to achieve accurate positioning or locating between lock piston 30 and lock-piston hole 31 in the circumferential direction. As a result, during the engine stopping period, it is possible to realize smooth engaging movement of lock piston 30 into lock-piston hole 31. With lock piston 30 and lock-piston hole 31, accurately positioned and engaged with each other, there is no undesirable circumferential displacement between lock piston 30 and lock-piston hole 31, which may occur owing to input torque transmitted to main housing portion 11 during operation of the engine.

Additionally, for accurate positioning, positioning recess 33 is integrally formed in the predetermined angular position of the outer peripheral edged portion of the rear end of main housing portion 11, accommodating therein vane member 7 (the first blade 22) that slidably supports lock piston 30, is integrally formed with. Positioning pin 34 is attached to rear plate portion 13. As discussed above, positioning recess 33 and positioning pin 34 cooperate with each other to enhance the accuracy of positioning.

Moreover, front and rear plate portions 12 and 13 are securely connected to each other by means of five bolts 14, circumferentially equidistant-spaced with respect to main housing portion 11, while sandwiching main housing portion 11 between front and rear plate portions 12 and 13. By way of metal touch (metal-to-metal contact) between the inside mating surface of front plate portion 12 and the front mating surface of main housing portion 11 and between the inside mating surface of rear plate portion 13 and the rear mating surface of main housing portion 11, it is possible to provide uniform oil seals and thus to enhance a good sealing performance.

Additionally, the circular-arc shaped, notched portion 22*a* of the first blade 22 is formed at only the left-hand half of the radially-outside portion of the first blade 22, facing or opposing the circular-arc shaped outer peripheral wall surface 18*a* of well-contoured portion 18 of the first shoe 8. Thus, although the seal groove is formed in the apex of the right-hand half of the radially-outside portion of the first blade 22, the circumferential width of the first blade 22 can be dimensioned as small as possible. As a result, it is possible to increase a phase change of vane member 7 relative to phase-converter housing 5, that is, a relative rotary motion of camshaft 2 to sprocket 1.

Furthermore, positioning recess 33 is formed in the predetermined angular position substantially corresponding to the circumferential center of well-contoured portion 18 of the first shoe 8 of main housing portion 11. For integrally forming the rectangular positioning recess 33, it is possible to effectively utilize a comparatively wide area of well-contoured portion 18. In forming the radially-extending slot-shaped positioning recess 33, the thickness of main housing portion 11 has to be dimensioned or set, taking into account the depth of positioning recess 33. The sintering-die forming portion of the first shoe 8, which is located in the left-hand side of the first blade 22 in FIGS. 4–5, is comparatively thick-walled, and thus there is no necessity to increase the thickness of main housing portion 11 for the provision of positioning recess 33. This contributes to the reduced outside diameter of the five-blade vane member equipped VTC mechanism. Additionally, in the assembled state, positioning pin 34 and positioning recess 33 are located close to lock-pin hole 31, thus more greatly enhancing the positioning accuracy of lock piston 30 and lock-piston hole 31.

In the hydraulically-operated five-blade vane member equipped VTC apparatus of the embodiment, as previously discussed, the first blade 22 has axial bore 29 that slidably accommodates therein lock piston 30, and thus the circumferential width W1 of the first blade 22 tends to be increased or large-sized by the diameter of axial bore 29 as compared to the other blades 23–26. Taking into account the maximum circumferential width W1 of the first blade 22, having axial bore 29, the circumferential width W2 of each of narrow-circumferential-width blades 23–24 is dimensioned or set to be less than the circumferential width W3 of each of middle-circumferential-width blades 25–26 (that is, $W2<W3$). Thus, it is possible to effectively reduce rotational unbalance of vane member 7 having five blades 22–26. Instead of setting the circumferential width W2 of each of the first pair of blades 23–24 to be less than the circumferential width W3 of each of the second pair of blades 25–26, in order to provide the same effects, a magnitude of centrifugal force acting on each of the first pair of blades 23–24, located on both sides of the first blade 22 having axial bore 29 slidably supporting lock piston 30, may be set to be less than a magnitude of centrifugal force acting on each of the second pair of blades 25–26, circumferentially spaced apart from the first blade 22 rather than the first pair 23–24. Alternatively, in order to provide the same effects, a weight of each of the first pair of blades 23–24, located on both sides of the first blade 22 having axial bore 29 slidably supporting lock piston 30, may be set to be less than a weight of each of the second pair of blades 25–26, circumferentially spaced apart from the first blade 22 rather than the first pair 23–24.

In the VTC apparatus of the embodiment, the number of blades of vane member 7 is set to "five". Generally, in case of the use of a five-blade vane member, there is an increased tendency for a range of phase change of a camshaft relative to a sprocket, that is, a range of relative rotary motion of the camshaft to the sprocket to be greatly limited as compared to a vane-type VTC apparatus employing a vane member having four or less blades. However, in the five-blade vane member equipped VTC apparatus of the embodiment, the circumferential width W2 of each blade of the narrow-circumferential-width blade pair (23, 24) is dimensioned or set to be less than the circumferential width W3 of each blade of the middle-circumferential-width blade pair (25, 26), and therefore it is possible to increase the range of phase change of vane member 7 (camshaft 2) relative to phase-converter housing 5 (sprocket 1).

Moreover, in the VTC apparatus of the embodiment, the circumferential width W3 of each blade of the middle-circumferential-width blade pair (25, 26) is dimensioned or set to be less the circumferential width W1 of the first blade (maximum-circumferential-width blade) 22 and greater than the circumferential width W2 of each blade of the narrow-circumferential-width blade pair (23, 24), thus enabling the increased range of phase change of vane member 7 (camshaft 2) relative to phase-converter housing 5 (sprocket 1), while ensuring good rotational balance of vane member 7.

In order to widen a range of phase change of vane member 7 (camshaft 2) relative to phase-converter housing 5 (sprocket 1) in the five-blade vane member equipped VTC apparatus, it is preferable that five blades 22–26 are laid out to be circumferentially equidistant-spaced from each other. For instance, the two adjacent blades (22,23; 23,25; 25,26; 26,24; 24,22) must be circumferentially spaced apart from each other by approximately 72 degrees. However, in case of such a circumferentially equidistant spaced layout of five blades 22–25, two blades 23–24 included in the narrow-circumferential-width blade pair (23, 24) tend to be slightly offset toward the first blade 22 from their accurately equidistant-spaced angular positions. Owing to the undesirable offset, the weight of the first blade side (the maximum-circumferential-width blade side) tends to become relatively greater than the opposite blade side (i.e., the middle-circumferential-width blade side). This causes undesirable rotational unbalance of vane member 7. To avoid this, in the five-blade vane member structure of the embodiment, the circumferential width W1 of the first blade (maximum-circumferential-width blade) 22 is dimensioned or set to be less than the sum (W3+W3) of circumferential widths of two blades 25–26 included in the middle-circumferential-width blade pair (25, 26). As a whole, the weight of vane member 7 can be circumferentially balanced and uniformed, thereby avoiding rotational unbalance of vane member 7.

In addition to the above, the weight of the first blade 22 is lightened by forming axial bore 29 therein. Taking into account such a light-weighted portion (that is, axial bore 29), the circumferential width W1 of the first blade (maximum-circumferential-width blade) 22 may be dimensioned to be substantially equal to the sum (W3+W3) of circumferential widths of two blades 25–26 included in the middle-circumferential-width blade pair (25, 26).

Additionally, in the shown embodiment, the circumferential width W3 of a first one 25 of two blades 25–26 included in the middle-circumferential-width blade pair (25, 26) is substantially identical to that of the second blade 26 of the middle-circumferential-width blade pair (25, 26). The volumetric capacities of a pair of variable-volume phase-retard and phase-advance chambers 9–10 partitioned by the first blade 25 of the middle-circumferential-width blade pair (25, 26) can be designed to be substantially identical to those of a pair of variable-volume phase-retard and phase-advance chambers 9–10 partitioned by the second blade 26. This contributes to the increased range of phase change of vane member 7 (camshaft 2) relative to phase-converter housing 5 (sprocket 1).

The circumferential width W1 of the first blade 22 is dimensioned or set to be greater than that of each of the other blades 23–26, and whereby the first blade (maximum-circumferential-width blade) 22 has a relatively high mechanical strength as compared to the other blades 23–26. For this reason, the maximum rotary movement of vane member 7 relative to phase-converter housing 5 in the phase-retard direction (see FIG. 4) or in the phase-advance direction (see FIG. 5), can be restricted by only abutment between the sidewall of the first blade 2 having the relatively high mechanical strength and the opposing shoe (the first or second shoes 8, 8). Note that, during abutment of the first blade 22 and the opposing shoe 8 in the maximum phase-retard position of vane member 7 (see FIG. 4) or in the maximum phase-advance position of vane member 7 (see FIG. 5,), the sidewalls of the other blades 23–26 are all kept out of contact with the respective sidewalls of the opposing shoes 8. As can be appreciated, each of non-contact blades 23–26 kept out of the respective sidewalls of the opposing shoes 8 in the maximum phase-retard position or in the maximum phase-advance position of vane member 7 mainly functions as a partition wall defining phase-retard and phase-advance chambers 9–10. On the other hand, the first blade 22, being able to be brought into abutted-engagement with the opposing shoe 8, functions as a stopper restricting both of the maximum phase-retard and phase-advance positions as well as a partition wall defining phase-retard and phase-advance chambers 9–10. Therefore, it is possible to reduce the circumferential width W2 of each of two blades 23–24 included in the narrow-circumferential-width blade pair (23, 24) and the circumferential width W3 of each of two blades 25–26 included in the middle-circumferential-width blade pair (25, 26), without reducing the life and durability of the five-blade vane member equipped VTC apparatus.

The VTC apparatus of the embodiment uses the five-blade vane member structure discussed above, and thus it is possible to provide a sufficient volumetric capacity in main housing portion 11, required for sufficient torque applied to vane member 7 for a phase change of vane member 7 (camshaft 2) relative to phase-converter housing 3 (sprocket 1), by means of five pairs of phase-retard and phase-advance chambers, defined and partitioned respective five blades 22–26. As a result of five blades 22–26, the axial length of the VTC device or the VTC unit can be shortened as much as possible. For instance, in case that the axially compactly designed VTC unit, having the shortened axial length, is applied to a transverse internal combustion engine, the axially compact VTC unit allows excellent mountability, thereby enhancing the flexibility and degree of freedom of layout in the engine room.

As a first modification, which is modified from the five-blade vane member structure of the embodiment, lock piston 30 (exactly, lock-piston hole 31) is eccentrically formed in the first blade 22 in such a manner as to be remarkably circumferentially offset from the center (exactly, the centroid) of the first blade 22, for example, in the counterclockwise direction in FIGS. 3–5. In this case, the circumferential width of one (for example, blade 26) of two blades 25–26 included in the middle-circumferential-width blade pair (25, 26), located circumferentially closer to eccentric lock piston 30 (eccentric lock-piston hole 31) of the first blade 22, has to be dimensioned to be less than that of the other (blade 25), located circumferentially apart from eccentric lock piston 30 (eccentric lock-piston hole 31) of the first blade 22 in comparison with the blade 26. This is because a cylindrical hollow (i.e., axial bore 29) exists in the first blade 22 and thus the weight of the left-hand half of the first blade 22, containing the major part of eccentric axial bore 29 circumferentially offsetting from the centroid of the first blade 22, tends to become less than the weight of the right-hand half of the first blade 22, containing the minor part of eccentric axial bore 29 circumferentially offsetting from the centroid of the first blade 22. For the reasons discussed above, blade 26, located circumferentially closer to eccentric axial bore 29 or eccentric lock-piston hole 31 (that is, the light-weighted portion) of the first blade 22, is relatively slightly down-sized in circumferential width and lightened, as compared to blade 25. In other words, blade 25, located circumferentially apart from eccentric axial bore 29 or eccentric lock-piston hole 31 (that is, the light-weighted portion) of the first blade 22, must be relatively slightly large-sized in circumferential width and weighed, as compared to blade 26. In case of eccentric axial bore 29 formed in the first blade 22, slightly down-sized blade 26 and slightly large-sized blade 25 cooperate with each other to maintain the total weight balance of the five-blade vane member 7. Thus, it is possible to effectively reduce or avoid the rotational unbalance of the five-blade vane member 7.

As previously described, in the shown embodiment, the sum (W3+W3) of circumferential widths of middle-width blades 25–26 included in the second pair (25, 26) is dimensioned or set to be greater than the circumferential width W1 of the first blade (maximum-circumferential-width blade) 22, that is, (W3+W3)>W1. In lieu thereof, the circumferential width W1 of the first blade 22 may be dimensioned or set to be greater than the sum (W3+W3) of circumferential widths of middle-width blades 25–26 included in the second pair (25, 26), that is, W1>(W3+W3). In this case, the first blade 22, having a cylindrical hollow (i.e., axial bore 29) formed therein, is lightened by axial bore 29 (the hollow portion), and thus it is desirable that the weights of middle-width blades 25–26 included in the second pair (25, 26) are both lightened. This contributes to avoidance of rotational unbalance of the five-blade vane member 7.

Figure 6:
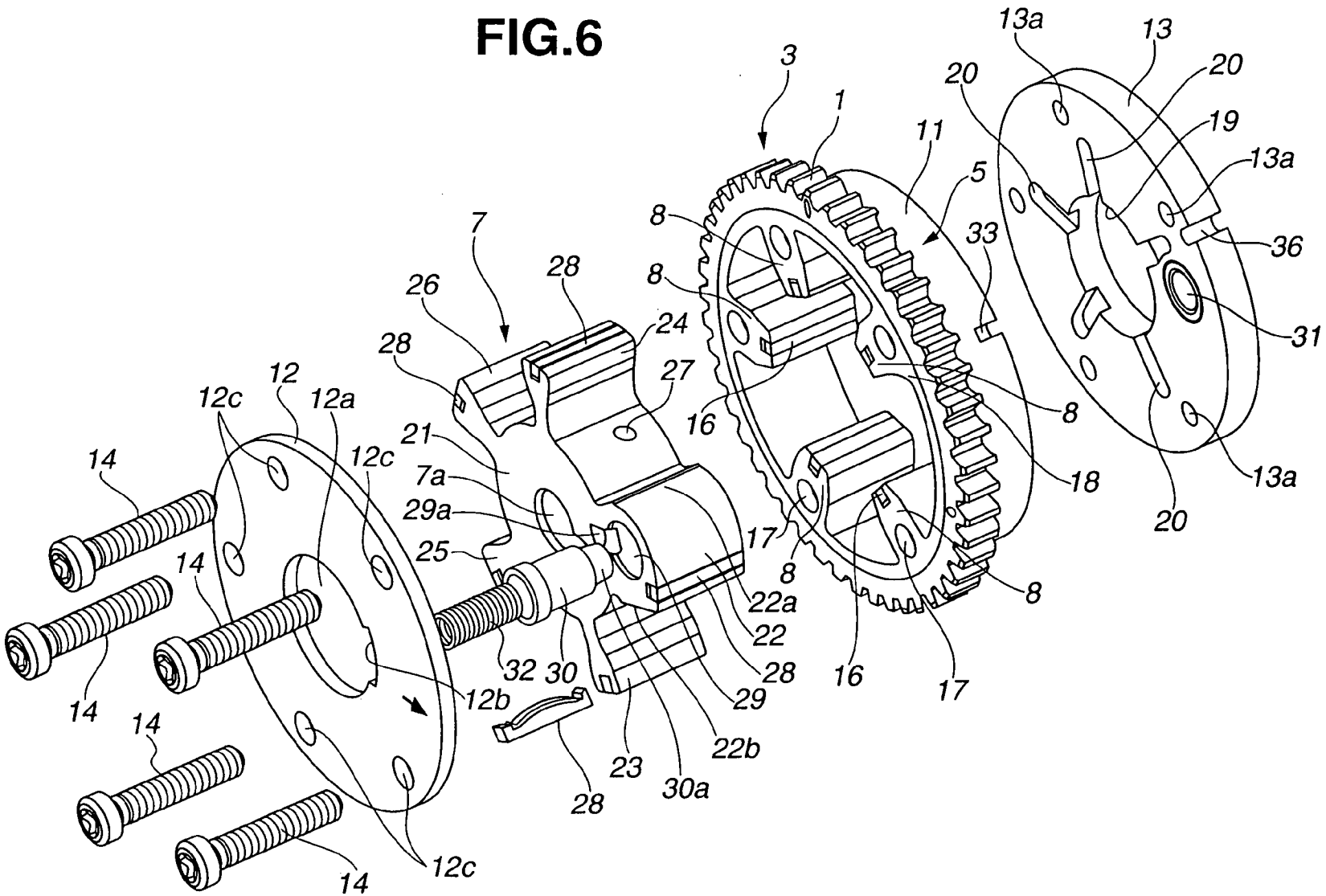
FIG. 6 is a disassembled view illustrating a modified hydraulically-operated five-blade vane member equipped VTC apparatus.

Referring now to FIG. 6, there is shown the modified hydraulically-operated five-blade vane member equipped VTC apparatus. The modified five-blade vane member equipped VTC apparatus of FIG. 6 is similar to the VTC apparatus of the embodiment of FIG. 1, except that the structure of positioning means of the modified VTC apparatus of FIG. 6 is differs from that of the VTC apparatus of the embodiment of FIG. 1. Thus, in explaining the modified VTC apparatus of FIG. 6, the same reference signs used to designate elements in the VTC apparatus of the embodiment shown in FIG. 1 will be applied to the corresponding reference signs used in the modified VTC apparatus shown in FIG. 6, for the purpose of comparison of the two different VTC apparatus. The structure of a positioning means of the modified VTC apparatus of FIG. 6 will be hereunder described in detail with reference to the accompanying drawings, while detailed description of the same reference signs will be omitted because the above description thereon seems to be self-explanatory.

As seen from the disassembled view of FIG. 6, the positioning means of the modified VTC apparatus is comprised of (i) a first positioning recess, which is the same positioning recess 33 as the VTC apparatus of the embodiment, and (ii) a second positioning recess 36, which is provided instead of using positioning pin 34 constructing a part of the positioning means of the VTC apparatus of the embodiment of FIG. 1. The first positioning recess 33 of main housing portion 11 and the second positioning recess 36 of rear plate portion 13 are accurately positioned in relation to each other by means of a positioning jig 37. More concretely, the second positioning recess 36 is integrally partially formed as an axially penetrated slot (having a substantially U-shaped lateral cross section) in a predetermined angular position of the outer periphery of rear plate portion 13 and located close to lock-pin hole 31. That is, the axially-penetrated, slotted positioning recess 36 has an upper opening end, thus avoiding the occurrence of an undesirable undercut portion during sintering-die forming for rear plate portion 13. This facilitates the sintering-die forming work.

Figure 7:
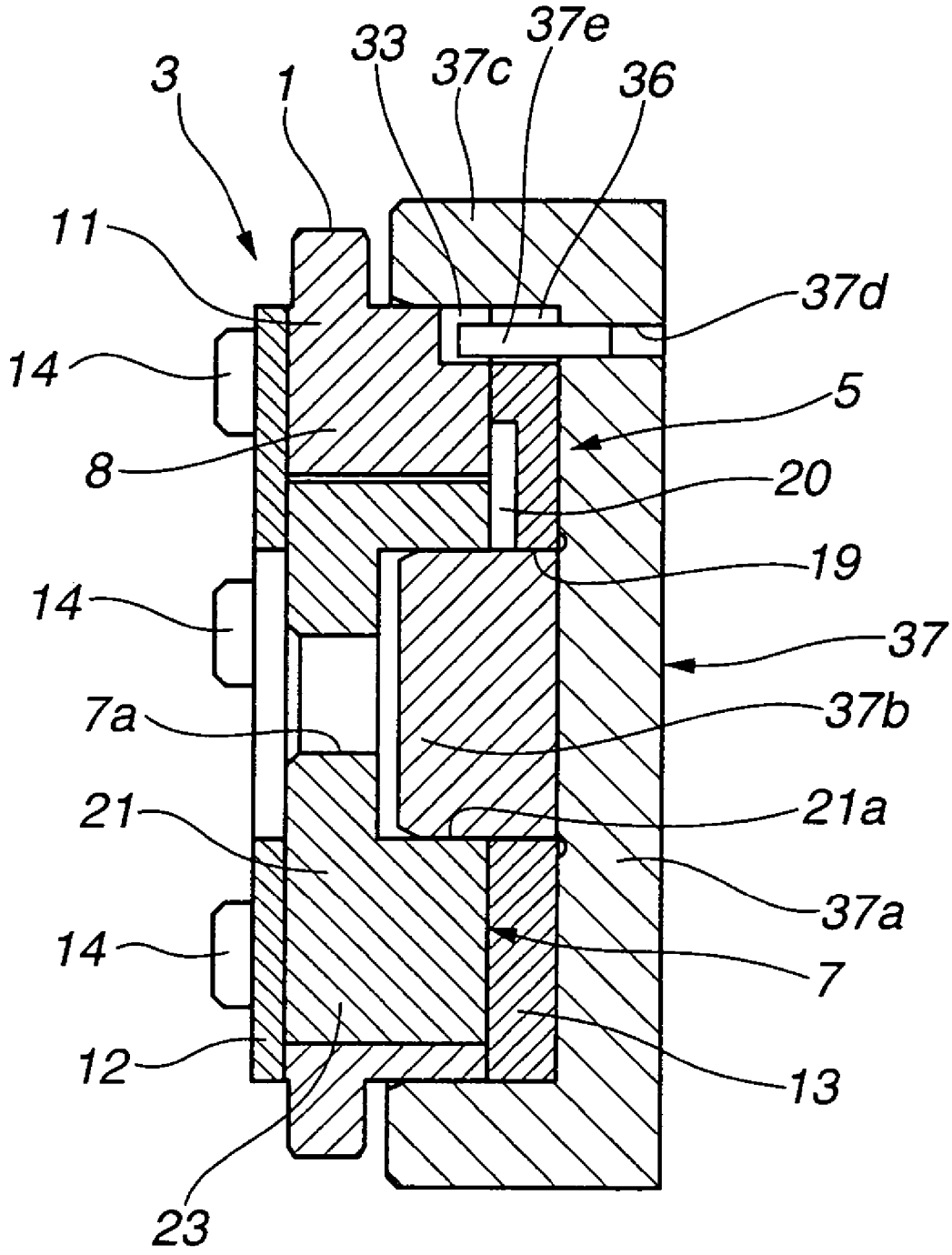
FIG. 7 is a longitudinal cross-sectional view explaining the assembling procedure of component parts constructing the modified hydraulically-operated five-blade vane member equipped VTC apparatus shown in FIG. 6.

As shown in FIG. 7, positioning jig 37 is substantially annular in shape and having a shallow doughnut-shaped bore almost closed at one end (see the right-hand bottom portion 37*a* in the longitudinal cross section of FIG. 7). Positioning jig 37 is comprised of an axially-protruding portion 37*b*, an annular peripheral wall portion 37*c*, and a positioning pin 37*e*. Axially-protruding portion 37*b* is formed to axially protrude from the center of bottom portion 37*a* and formed integral with the same. Axially-protruding portion 37*b* is formed as a substantially cylindrical axially-protruding portion, which is axially fitted into fitting groove 21*a* of vane rotor 21 when assembling. Annular peripheral wall portion 37*c* is formed integral with bottom portion 37*a*. When assembling, annular peripheral wall portion 37*c* is axially fitted onto both of the outer peripheral wall surface of rear plate portion 13 and the outer peripheral wall surface of the rear end of main housing portion 11 from the rear end of rear plate portion 13. On the other hand, positioning pin 37*e* is press-fitted into a positioning-pin retaining axial bore 37*d*, which is axially bored in the peripheral portion of rear plate portion 13 as a through opening and located close to annular peripheral wall portion 37*c* formed integral with bottom portion 37*a*. For accurate positioning between the angular position of main housing portion 11 and the angular position of rear plate portion 13, and for zero backlash (no occurrence of relative circumferential motion) of two parts, namely main housing portion 11 and rear plate portion 13, the circumferential width of the first positioning recess 33, the inside diameter of the second positioning recess 36, and the outside diameter of positioning pin 37*e* are properly dimensioned. Concretely, the outside diameter of positioning pin 37*e* is dimensioned or set to be slightly less than each of the circumferential width of the first positioning recess 33 and the inside diameter of the second positioning recess 36.

When assembling or installing front and rear plate portions 12 and 13 on both faces of main housing portion 11, the assembling procedure of the modified VTC apparatus of FIG. 6 is basically similar to that of the VTC apparatus of the embodiment of FIG. 1. However, when locating or installing rear plate portion 13 on the rear end face of main housing portion 11, the assembling procedure of the modified VTC apparatus of FIG. 6 is somewhat different from that of the VTC apparatus of the embodiment of FIG. 1, as hereunder described in detail.

When locating or installing rear plate portion 13 on the rear end face of main housing portion 11, first, the angular position of the first positioning recess 33 of main housing portion 11 and the angular position of the second positioning recess 36 of rear plate portion 13 are temporarily aligned with each other in the circumferential direction. After this, as can be seen from the cross section of FIG. 7, when axially fitting axially-protruding portion 37*b* into fitting groove 21*a* of vane rotor 21 and simultaneously axially fitting annular peripheral wall portion 37*c* onto both of the outer peripheral wall surface of rear plate portion 13 and the outer peripheral wall surface of the rear end of main housing portion 11 from the rear end of rear plate portion 13, (i) positioning pin 37*e* is axially fitted into the second positioning recess 36 of rear plate portion 13, and thereafter (ii) positioning pin 37*e* is further fitted into the first positioning pin 33 of main housing portion 11. Under these conditions, it is possible to achieve accurate positioning of the circumferential position of rear plate portion 13 relative to main housing portion 11 by screwing the male screw-threaded portions of bolts 14 into the respective female screw-threaded portions 13*a* of rear plate portion 13, until the predetermined tightening torque for tightening each of bolts 14 is reached. As a result of this, accurate positioning between the angular position of lock piston 30 (the vane member side) and the angular position of lock-piston hole 31 (the rear plate side) in the circumferential direction of phase-converter housing 5 is attained. After the previously-noted assembling procedure of component parts of the modified five-blade vane member equipped VTC apparatus has been completed, the previously-discussed positioning jig 37 is axially removed from the assembled VTC mechanism. As can be appreciated from the above, the modified five-blade vane member equipped VTC apparatus of FIG. 6 can provide the same operation and effects as the five-blade vane member equipped VTC apparatus of the embodiment of FIG. 1. Positioning pin 34 (see FIG. 1) can be eliminated only by simply forming the second positioning recess 36 (see FIG. 6) in rear plate portion 13. This contributes to the reduced manufacturing costs.

Although the complicated positioning jig 37 is used in assembling component parts of the modified VTC apparatus of FIG. 6, the shape and structure of the positioning jig may be simplified. For instance, a minus screwdriver may be used as a simplified jig used to position and hold component parts of the five-blade vane member equipped VTC apparatus, in particular, main housing portion 11 with five-blade vane member 7, and front and rear plate portions 12–13, when assembling. Alternatively, such a positioning jig 37 may be eliminated. In this case, the first positioning recess 33 of main housing portion 11 and the second positioning recess 36 of rear plate portion 13 can be circumferentially aligned and positioned by way of visual observation.

The entire contents of Japanese Patent Application No. 2004-252258 (filed Aug. 31, 2004) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve timing control apparatus of an internal combustion engine comprising:

a rotary member adapted to be driven by an engine crankshaft;

a camshaft rotatable relative to the rotary member and adapted to have a series of cams for operating engine valves;

a phase converter comprising:

(a) a rotary phase-converter housing integrally connected to one of the rotary member and the camshaft, and having a lock-piston hole formed in the housing; and (b) a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers;

a hydraulic circuit provided to supply hydraulic pressure selectively to either one of each of the phase-retard chambers and each of the phase-advance chambers to change a phase angle of the vane member relative to the housing;

a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle; and an area of an outside circumference of each of a first pair of blades, located on both sides of the first blade having the bore slidably supporting the lock piston, being dimensioned to be less than an area of an outside circumference of each of a second pair of blades, circumferentially spaced apart from the first blade rather than the first pair.

2. The variable valve timing control apparatus as claimed in claim 1, wherein:

the area of the outside circumference of each of the second pair is dimensioned to be less than an area of an outside circumference of the first blade and greater than the area of the outside circumference of each of the first pair.

3. The variable valve timing control apparatus as claimed in claim 2, wherein:

the area of the outside circumference of the first blade is dimensioned to be less than a sum of the areas of the outside circumferences of the second pair.

4. The variable valve timing control apparatus as claimed in claim 3, wherein:

the areas of the outside circumferences of the second pair are substantially identical to each other.

5. The variable valve timing control apparatus as claimed in claim 1, wherein:

the bore of the first blade, slidably supporting the lock piston, comprises an eccentric bore being circumferentially offset from a centroid of the first blade; and the area of the outside circumference of one of the second pair, located circumferentially closer to the eccentric bore, is dimensioned to be less than the area of the outside circumference of the other of the second pair, located circumferentially apart from the eccentric bore formed in the first blade in comparison with the one blade of the second pair.

6. The variable valve timing control apparatus as claimed in claim 2, wherein:

the housing having five partitions integrally formed on an inner peripheral wall and cooperating with the five blades for defining the five phase-retard chambers and the five phase-advance chambers;

the first blade comprises a contact blade, whose both sidewalls are brought into abutted-engagement with respective sidewalls of the associated two adjacent partitions, located on both sides of the contact blade, for restricting maximum phase-retard and phase-advance positions of the vane member relative to the housing; and each of the first pair of blades and the second pair of blades comprises a non-contact blade, whose both sidewalls are kept out of contact with respective sidewalls of the associated two adjacent partitions, located on both sides of the non-contact blade, in maximum phase-retard and phase-advance positions of the vane member relative to the housing.

7. The variable valve timing control apparatus as claimed in claim 1, wherein:

the area of the outside circumference of the first blade is dimensioned to be greater than a sum of the areas of the outside circumferences of the second pair.

8. A variable valve timing control apparatus of an internal combustion engine comprising:

a rotary member adapted to be driven by an engine crankshaft;

a camshaft rotatable relative to the rotary member and adapted to have a series of cams for operating engine valves;

a phase converter comprising:

(a) a rotary phase-converter housing integrally connected to one of the rotary member and the camshaft, and having a lock-piston hole formed in the housing; and (b) a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers;

a hydraulic circuit provided to supply hydraulic pressure selectively to either one of each of the phase-retard chambers and each of the phase-advance chambers to change a phase angle of the vane member relative to the housing;

a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle; and a magnitude of centrifugal force acting on each of a first pair of blades, located on both sides of the first blade having the bore slidably supporting the lock piston, being set to be less than a magnitude of centrifugal force acting on each of a second pair of blades, circumferentially spaced apart from the first blade rather than the first pair.

9. The variable valve timing control apparatus as claimed in claim 8, wherein:

an area of an outside circumference of each of the second pair is dimensioned to be less than an area of an outside circumference of the first blade and greater than an area of an outside circumference of each of the first pair.

10. The variable valve timing control apparatus as claimed in claim 9, wherein:

the area of the outside circumference of the first blade is dimensioned to be less than a sum (W3+W3) of the areas of the outside circumferences of the second pair.

11. The variable valve timing control apparatus as claimed in claim 10, wherein:

the areas of the outside circumferences of the second pair are substantially identical to each other.

12. The variable valve timing control apparatus as claimed in claim 9, wherein:

the housing having five partitions integrally formed on an inner peripheral wall and cooperating with the five blades for defining the five phase-retard chambers and the five phase-advance chambers;

the first blade comprises a contact blade, whose both sidewalls are brought into abutted-engagement with respective sidewalls of the associated two adjacent partitions, located on both sides of the contact blade, for restricting maximum phase-retard and phase-advance positions of the vane member relative to the housing; and each of the first pair of blades and the second pair of blades comprises a non-contact blade, whose both sidewalls are kept out of contact with respective sidewalls of the associated two adjacent partitions, located on both sides of the non-contact blade, in maximum phase-retard and phase-advance positions of the vane member relative to the housing.

13. The variable valve timing control apparatus as claimed in claim 8, wherein:

the bore of the first blade, slidably supporting the lock piston, comprises an eccentric bore being circumferentially offset from a centroid of the first blade; and an area of an outside circumference of one of the second pair, located circumferentially closer to the eccentric bore, is dimensioned to be less than an area of an outside circumference of the other of the second pair, located circumferentially apart from the eccentric bore formed in the first blade in comparison with the one blade of the second pair.

14. The variable valve timing control apparatus as claimed in claim 8, wherein:

a weight of each of a first pair of blades, located on both sides of the first blade having the bore slidably supporting the lock piston, being set to be less than a weight of each of a second pair of blades, circumferentially spaced apart from the first blade rather than the first pair.

15. A variable valve timing control apparatus of an internal combustion engine comprising:

a rotary member adapted to be driven by an engine crankshaft;

a camshaft rotatable relative to the rotary member and adapted to have a series of cams for operating engine valves;

a phase converter comprising:

(a) a rotary phase-converter housing integrally connected to one of the rotary member and the camshaft, and having a lock-piston hole formed in the housing; and (b) a five-blade vane member having five blades radially extending from an outer periphery thereof and rotatably disposed in the housing and integrally connected to the other of the rotary member and the camshaft, the five blades of the vane member and the housing cooperating with each other to define five variable-volume phase-retard chambers and five variable-volume phase-advance chambers;

a hydraulic circuit provided to supply hydraulic pressure selectively to either one of each of the phase-retard chambers and each of the phase-advance chambers to change a phase angle of-the vane member relative to the housing;

a lock piston slidably supported in a bore formed in a first one of the five blades, and being engaged with the lock-piston hole in a specified phase angle of the vane member relative to the housing and disengaged from the lock-piston hole in a phase-angle range of the vane member except the specified phase angle; and a maximum circumferential width of each of a first pair of blades, located on both sides of the first blade having the bore slidably supporting the lock piston, being dimensioned to be less than a maximum circumferential width of each of a second pair of blades, circumferentially spaced apart from the first blade rather than the first pair.

16. The variable valve timing control apparatus as claimed in claim 15, wherein:

an area of an outside circumference of each of the second pair is dimensioned to be less than an area of an outside circumference of the first blade and greater than an area of an outside circumference of each of the first pair.

17. The variable valve timing control apparatus as claimed in claim 16, wherein:

the area of the outside circumference of the first blade is dimensioned to be less than a sum of the areas of the outside circumferences of the second pair.

18. The variable valve timing control apparatus as claimed in claim 17, wherein:

the areas of the outside circumferences of the second pair are substantially identical to each other.

19. The variable valve timing control apparatus as claimed in claim 16, wherein:

the housing having five partitions integrally formed on an inner peripheral wall and cooperating with the five blades for defining the five phase-retard chambers and the five phase-advance chambers;

the first blade comprises a contact blade, whose both sidewalls are brought into abutted-engagement with respective sidewalls of the associated two adjacent partitions, located on both sides of the contact blade, for restricting maximum phase-retard and phase-advance positions of the vane member relative to the housing; and each of the first pair of blades and the second pair of blades comprises a non-contact blade, whose both sidewalls are kept out of contact with respective sidewalls of the associated two adjacent partitions, located on both sides of the non-contact blade, in maximum phase-retard and phase-advance positions of the vane member relative to the housing.

20. The variable valve timing control apparatus as claimed in claim 15, wherein:

the bore of the first blade, slidably supporting the lock piston, comprises an eccentric bore being circumferentially offset from a centroid of the first blade; and an area of an outside circumference of one of the second pair, located circumferentially closer to the eccentric bore, is dimensioned to be less than an area of an outside circumference of the other of the second pair, located circumferentially apart from the eccentric bore formed in the first blade in comparison with the one blade of the second pair.

* * * * *